US007892714B2

(12) United States Patent
McDougall et al.

(10) Patent No.: US 7,892,714 B2
(45) Date of Patent: Feb. 22, 2011

(54) TONER PARTICLES HAVING NANO-SIZED COMPOSITES CONTAINING POLYMER MODIFIED CLAYS

(75) Inventors: Maria N. V. McDougall, Oakville (CA); Richard P. N. Veregin, Mississauga (CA); Guerino G. Sacripante, Oakville (CA); Valerie M. Farrugia, Oakville (CA)

(73) Assignee: Xerox Corporation, Norwalk, CT (US)

( * ) Notice: Subject to any disclaimer, the term of this patent is extended or adjusted under 35 U.S.C. 154(b) by 787 days.

(21) Appl. No.: 11/840,431

(22) Filed: Aug. 17, 2007

(65) Prior Publication Data

US 2009/0047591 A1 Feb. 19, 2009

(51) Int. Cl.
*G03G 9/08* (2006.01)

(52) U.S. Cl. ..... 430/108.3; 430/108.6; 430/108.7; 430/110.2; 430/108.4

(58) Field of Classification Search ..... 430/108.6, 430/108.7, 108.3, 110.2, 108.4
See application file for complete search history.

(56) References Cited

U.S. PATENT DOCUMENTS 5,288,581 A 2/1994 Ziolo
6,914,095 B2 7/2005 Lorah et al.
7,309,558 B1 12/2007 Michel et al.
2007/0003855 A1 * 1/2007 Veregin et al. ..... 430/108.3
2008/0107986 A1 * 5/2008 Michel et al. ..... 430/135
2009/0047595 A1 2/2009 McDougall et al.

FOREIGN PATENT DOCUMENTS

EP 1 739 496 A 1/2007
EP 1 835 351 A 9/2007
WO WO 01/40878 A 6/2001
WO WO 2005111729 A2 * 11/2005

OTHER PUBLICATIONS

Springer-Verlag Berlin Heidelberg, "Advances in Polymer Science", vol. 179, pp. 61-66, 136-141 and 149, 2005.
May 26, 2010 Office Action issued in U.S. Appl. No. 11/840,418.
Office Action dated Oct. 4, 2010 issued in U.S. Appl. No. 11/840,418.
European Office Action issued on Sep. 10, 2010 in related European Patent Application No. 08158485.6.

* cited by examiner

*Primary Examiner*—Christopher RoDee
(74) *Attorney, Agent, or Firm*—Oliff & Berridge, PLC

(57) ABSTRACT

A toner comprising toner particles, a polymer binder, at least one colorant and clay composites distributed in the polymer binder, wherein the clay composites comprise a polymer modified clay.

23 Claims, No Drawings

TONER PARTICLES HAVING NANO-SIZED COMPOSITES CONTAINING POLYMER MODIFIED CLAYS

BACKGROUND

Disclosed herein are nano-sized composites and a method for making toner particles or developers using these composites. Each nano-sized composite may contain a polymer modified clay that may include, for example, polystyrene, polyester and the like. The nano-sized composites may have clay platelets orientated in an intercalated, exfoliated or tactoid structure or a dispersion of clay particles within a polymer matrix.

The nano-sized composites may be incorporated into a bulk or a binder of a toner, such as a conventional toner or an emulsion aggregation toner. Incorporating the nano-sized composites into toner particles improves relative humidity (hereinafter "RH") sensitivity of the toner and charging performance in low and/or high humidity conditions. The nano-sized composites within the toner particles may be advantageous in improving one or more of elastic modulus, reducing water vapour permeability or additive impaction, raising blocking temperature and vinyl document offset.

Toners, such as emulsion aggregation (hereinafter "EA") toners, are excellent toners to use in forming print and/or xerographic images in that the toners can be made to have uniform sizes and in that the toners are environmentally friendly. Common types of emulsion aggregation toners include emulsion aggregation toners that are acrylate resin based or that are polyester resin based toner particles.

Emulsion aggregation techniques typically involve the formation of an emulsion latex of the resin particles, which particles may be nano-sized from, for example, about 5 to about 500 nanometers in diameter, by heating the resin, optionally with solvent if needed, in water, or by making a latex in water using emulsion polymerization. A colorant dispersion, for example of a pigment dispersed in water, optionally also with additional resin, is separately formed. The colorant dispersion is added to the emulsion latex mixture, and the mixture is aggregated, for example at an elevated temperature, optionally with addition of an aggregating agent or complexing agent, to form aggregated toner particles. The aggregated toner particles are optionally further heated to enable coalescence and fusing, thereby achieving aggregated, fused toner particles.

Digital printing images are formed using toner compositions with a printer. The toner compositions typically include small powders having small toner sized particles with a controlled particle shape. However, small toner sized particles often cause performance difficulties because of the physics associated with the small toner sized particles. As a result, external surface additives, such as metal oxides, are added to the small toner sized particles to control charging stability, toner flow, toner adhesion and/or blocking. However, with time and damage from developing housings, the toner flow and toner adhesion of the small toner sized particles may change and the small toner sized particles can block, which affects image quality.

Additionally, charging with metal oxide additives may often cause the small toner sized particles to exhibit a higher relative humidity sensitivity (hereinafter "RH") than desired, and thus may not perform well in all humidities. It is desirable that the toner compositions be functional under all environmental conditions to enable good image quality of the digital printing images from the printer. In other words, it is desirable for the developers to function both at low humidity such as a 10% RH/15° C. relative humidity (denoted herein as C-zone) and a high humidity such as at 85% RH/28° C. relative humidity (denoted herein as A-zone).

Thus, the physics of small powders, such as small toner sized particles or EA toner particles, can cause several problems for developers that hinder the ability to form high quality images.

One solution to these problems has been to add external surface additives to the toner compositions. Such external surface additives may include metal oxides to control developer charging stability, toner flow, toner adhesion, transfer and blocking. However, with time and abuse from the developing housings, developer stability, toner flow and toner adhesion change and the toner may block, which may affect image quality. Additionally, charging small toner sized particles with metal oxide additives often provides higher RH sensitivity than desired.

Additive impaction of (external surface additives being embedded into toner) which leads to charge, flow and adhesion degradation, may be improved by increasing resin elasticity by modifying polymer properties of the small toner sized particles. To modify the polymer properties, a gel or a second higher molecular weight (hereinafter "Mw") distribution polymer may be added to the toner or the small toner sized particles. Thus, blocking may be improved by increasing a glass transition temperature (hereinafter "Tg") of the toner compositions. However, the gel or the second higher Mw distribution polymer may cause an increase in the minimum fusing temperature (hereinafter MFT), which is disadvantageous because a higher fuser roll temperature and also higher pressure will be needed, which may cause a decrease in the life of fusing rolls system.

The RH sensitivity for the toner compositions may be improved by adding a charge control agent to the bulk of the toner formed from the small toner sized particles. However, addition of a charge control agent (CCA) to the bulk of the toner is often unsuccessful for toners because the CCA often increases toner charging only in C-zone conditions and not in A-zone conditions, leading to higher RH sensitivity.

Thus, a need exists for better methods to improve RH sensitivity and charging performance of toner particles while avoiding problems associated with the inclusion of external surface additives and the like.

SUMMARY

In embodiments, disclosed herein are toner particles that include a polymer binder and at least one colorant. Moreover, the toner particles include nano-sized clay composites distributed in the binder, wherein the nano-sized clay composites comprise a polymer modified clay component, and wherein the nano-sized clay composites have a structure selected from the group consisting of an exfoliated structure, an intercalated structure, a tactoid structure, and mixtures thereof.

In further embodiments, disclosed is a toner that includes toner particles having a core with a shell layer thereon, the core comprising a binder and at least one colorant, and the shell comprising a binder, and wherein the core binder, the shell binder, or both further includes nano-sized clay composites comprised of polymer modified clay component, and wherein the nano-sized clay composites have a structure selected from the group consisting of an exfoliated structure, an intercalated structure, a tactoid structure, and mixtures thereof.

In yet further embodiments, disclosed are toner particles that include a polymer binder and at least one colorant. Moreover, the toner particles include nano-sized clay composites distributed in the binder, wherein the nano-sized clay composites comprise a polymer modified clay component, wherein the polymer modified clay component comprises silicate clay particles, wherein the nano-sized clay composites have a structure selected from the group consisting of an exfoliated structure, an intercalated structure, a tactoid structure, and mixtures thereof.

EMBODIMENTS

Disclosed herein are nano-sized clay composites comprising polymer modified clays. The term "nano-sized" refers to, for example, average particle sizes of from about 1 nm to about 300 nm. For example, the nano-sized particles may have a size of from about 50 nm to about 300 nm, or from about 125 nm to about 250 nm. The nano-sized clay composites thus may have average particle sizes from about 1 nm to about 300 nm, from about 50 nm to about 300 nm, or from about 125 nm to about 250 nm. The average particles sizes may be determined using any suitable device for determining the size of nanometer sized materials. Such devices are commercially available and known in the art, and include, for example, a Coulter Counter.

In embodiments, the polymer may be a polyester resin, a styrenic resin or an acrylate resin. Additionally, clay may be, in embodiments, a silicate clay or the like.

The nano-sized clay composites may be incorporated into a bulk of the toner, such as a conventional toner or emulsion aggregation (EA) toner, to form toner particles. In an EA toner, the nano-sized clay composites may be incorporated into a binder of a core portion and/or a shell portion of the toner particles. Of course, the toner particles need not include a shell portion, in which case the nano-sized clay composites are distributed in the toner particles themselves without any shell. Toners including the nano-sized composites of polymer modified clays may exhibit improved elastic modulus, charging performance and RH sensitivity and a reduction in water vapor permeability and additive impaction. As a result, these toners may exhibit improved blocking temperature and vinyl offset.

Vinyl offset may be caused by exposure to heat and/or UV light. By increasing the elasticity of the toner particles with use of nano-sized clay composites, vinyl offset of the toner particles may be prevented or avoided. With respect to RH sensitivity, the toners including the nano-sized clay composites may prevent high charging in low humidity conditions and low charging in high humidity conditions. Moreover, the nano-sized composites of polymer modified clays increase elasticity of the toner particles and may provide an improved and more stable quality image.

The nano-sized clay composites include a polymer modified clay. The polymer modified clay may be a hybrid that may be based on layered inorganic compounds, such as silicate clays. A type of clay, a choice of clay pre-treatment, a selection of polymer component and a method in which the polymer is incorporated into the nano-sized composite may determine the properties of the nano-sized composites. Controlling nanoparticle dispersion of the silicate clays and/or the polymer in nano-sized composites may also determine the properties of nano-sized composites.

Suitable silicate clays for use in the nano-sized clay composites and incorporation into the toner particles may include, for example, aluminosilicates and the like. The silicate clays may have a sheet-like or layered structure, and may consist of silica $SiO_4$ tetrahedra bonded to alumina $AlO_6$ octahedra. A ratio of the tetrahedra to the octahedra may be, for example, 2 to 1 for forming smectite clays, such as a magnesium aluminum silicate, also known as montmorillonite. Montmorillonite thus may be used for nano-sized composite formation.

In embodiments, other suitable clays for nano-sized composite formation may include magnesium silicates also known as hectorites, such as magnesiosilicates or synthetic clays, such as hydrotalcites. The hectorites may contain very small platelets, and the hydrotalcite may be produced to carry a positive charge on the platelets, in contrast to the negative charge that may be found on the platelets of montmorillonite.

In embodiments, the silicate clay may include kaolin clay. Kaolin clay is also known as China clay or Paper clay. It is composed of the mineral kaolinite, an aluminosilicate, and is a hydrated silica of alumina with a composition of about 46% silica, about 40% alumina and about 14% water. Examples of suitable kaolin clay particles are Huber 80, Huber 90, Polygloss 80 and Polygloss 90. Other suitable examples of natural refined kaolin clays are DIXIECLAY®, PAR®, and BILTPLATES® 156 from R.T. Vanderbilt Company, Inc. As with kaolin clay, the silicate clay may or may not be hydrated. The silicate clay may also be treated with an inorganic or organic material.

Other silicate clays that can be utilized may include bentonite clays. Alternatively, the silicate clays may be the magnesium aluminum silicates that may include natural refined silicates such as GELWHITE® MAS 100(SC), GELWHITE® MAS 101, GELWHITE® MAS 102 AND GELWHITE® MAS 103, GELWHITE® L, GELWHITE® GP, BENTOLITE® MB, and CLOISITE® Na+, from Rockwood Additives Ltd. (UK). The magnesium aluminum silicate clay may also be treated by an organic agent, such as CLOISITE® 10A, 15A, 20A, 25A, 30B and 93A which are natural montmorillonite modified with a quaternary ammonium salt, or CLAYTONE® HY, CLAYTONE® SO, all available from Rockwood Additives Ltd. UK). Other organic modified montmorillonites may include, for example, CLAYTONE® 40, APA, AF, HT, HO, TG, HY, and 97 from Rockwood Additives Ltd. (UK). Examples of magnesium silicates include, for example, synthetic layered magnesium silicates such as LAPONITE RD, LAPONITE RDS (that incorporates an inorganic polyphosphate peptizer), LAPONITE B (a fluorosilicate), LAPONITE S (a fluorosilicate incorporating an inorganic polyphosphate peptiser), LAPONITE D and DF (surface modified with fluoride ions), and LAPONITE JS (a fluorosilicate modified with an inorganic polyphosphate dispersing agent), all from Rockwood Additives Ltd. (UK).

The silicate clay particles can have a small size, for example on the order of from, about 1 nm to about 500 nm or from about 10 nm to about 200 nm, on average. Further, the silicate clay particles may have a specific surface area of from about 10 to about 400 $m^2/g$ or from about 15 to about 200 $m^2/g$.

The sheet-like or layered structure may have layers with a surface and/or edges that may bear a charge thereon. The sheet-like or layered structure may have an inter-layer spacing between the clay which may contain counter-ions for producing a charge to counter the charge at the surface and/or the edges of the structure. Further, the counter-ions may reside, in part, in the inter-layer spacing of the clay. A thickness of the layers of the sheet-like or layer structure, also known as platelets, may be about 1 nm or more. As a result, the platelets may have aspect ratios in a range of about 100 to about 1500. The platelets may have a molecular weight of about $1.3\times10^8$ or the like.

In embodiments, the platelets of silicate clays may not be rigid and may have a degree of flexibility. The silicate clays may have an ion exchange capacity, such as, cation or anion. As a result, the silicate clays may be highly hydrophilic species and may be incompatible with a wide range of polymer types. Thus, to form polymer-clay nano-sized composites, the clay polarity for the silicate clays may require modification to make the silicate clays into organophilic species and the like. An organophilic clay species may be produced from a normally hydrophilic silicate clay by ion exchange with an organic cation, such as an alkylammonium ion. For example, in montmorillonite, the sodium ions in the silicate clay may be exchanged for an amino acid, such as 12-aminododecanoic acid (ADA):

$$Na^{+}\text{-CLAY}+HO_2C—R—NH_3^{+}Cl^{-} \underset{\alpha}{\rightarrow} HO_2C—R—NH_3^{+}\text{-CLAY}+NaCl \quad (1)$$

R in equation (1) may refer to an organic group, such as an alkyl or aryl group, and α may be related to the position of the amino group location with respect to a first carbon molecule of the acid group in the amino acid chain.

A synthetic route of choice for forming the nano-sized composite may be based on whether the resulting structure of silicate clay is an intercalated hybrid stricture, exfoliated hybrid structure or a tactoid structure. For the intercalate hybrid stricture, an organic component may be inserted between the layers or platelets of clay. As a result, the interlayer spacing between the clay may be expanded, but the layers or platelets may bear a well-defined spatial relationship with respect to each other. In an exfoliated hybrid structure, the layers or platelets of clay may have been completely separated and individual layers or platelets may be distributed throughout the organic matrix. A third alternative may be a dispersion of complete clay particles, such as tactoids, within a polymer matrix. As a result, the dispersion of clay may be used as conventional filler and the like.

An exchange capacity of the clay, a polarity of the reaction medium and a chemical nature of the interlayer cations, such as onium ions, may affect delamination of the clay. By modifying surface polarity of the clay, the onium ions may allow thermodynamically favorable penetration of polymer precursors into an interlayer region of the structure. The onium ions may assist in delamination of the clay based on, a polarity of the onium ion. With positively charged clays such as hydrotalcite, an onium salt modification may be replaced by an anionic surfactant. Other suitable clay modifications may be utilized based on the polymer that is used in formation of the nano-sized lay composite. Suitable clay modification for silicate clays to produce organophilic species may include modification of the silicate clays via ion-dipole interactions of the clays, use of silane coupling agents, use of block copolymers and the like.

An example of ion-dipole interactions for the nano-sized composites may include intercalation of a small molecule such as dodecylpyrrolidone into the clay. Entropically-driven displacement of the small molecules may provide a route to introducing polymer molecules. Unfavorable interactions of the edges of the clay and the polymers may be overcome by use of silane coupling agents to modify the edges of the clay. The unfavorable interactions may be used in conjunction with the onium ion treated clay to form an organo-clay structure.

Alternatively, compatibilizing clays with polymers, based on use of block or graft copolymers where one component of the copolymer is compatible with the clay and the other with the polymer matrix, may be utilized to avoid the interactions of the clay. A typical block copolymer may include a clay-compatible hydrophilic block and a polymer-compatible hydrophobic block. As a result, high degrees of exfoliation may be achieved. The structure of a typical polymer-compatible hydrophobic block may be:

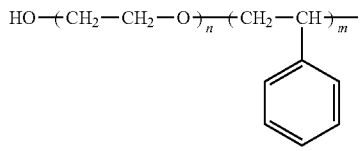

In the structure of the typical polymer-compatible hydrophobic block, n and/or m may have a value from about 10 units to about 1000 units, from about 50 units to about 800 units or from 100 units to about 700 units.

The silicate clay may be selected to provide polymer modified clays that may be effectively penetrated by the polymer or a precursor into the interlayer spacing of the clay. As a result, a desired exfoliated or intercalated hybrid structure may be produced from the polymer or the precursor penetrating the interlayer spacing of the clay. In embodiments, the polymer may be incorporated either as the polymeric species or via the monomer, which may be polymerized in situ to produce the nano-sized composite having the polymer modified clays.

In embodiments, the polymers for modifying the clay may be introduced into the clay by a melt blending process, such as extrusion, or by solution blending process. The melt blending or compounding process may depend on shear to promote delamination of the clay and may be less effective than the in situ polymerization for producing an exfoliated nano-sized composite.

Both thermoset and thermoplastic polymers may be incorporated into nano-sized composites by the melt blending process or the solution blending process. Suitable thermosets and thermoplastics for incorporation into the clays may include nylon, polyolefins, such as polypropylene, polystyrene, ethylene-vinyl acetate (hereinafter "EVA") copolymer, epoxy resins, polyurethanes, polyimides, polyesters, polyamides, polycarbonates, or poly(ethylene terephthalate) (hereinafter "PET") and the like. The clay may be present in the polymer modified clays in an amount of from about 1 to about 20 percent by weight of the polymer modified clays or from about 2 to about 10 percent by weight of the polymer modified clays.

The nano-sized composites may also be prepared or formed by introducing the polymer via in-situ polymerization of monomers in the presence of the clay, for example, emulsion polymerization of, for example, styrene in the presence of reactive organophilic clay. The reactive organophilic clay may be synthesized by exchanging the inorganic cations in the interlayer hybrid structure of natural clay with, for example, the quaternary salt of the aminomethylstyrene. The quaternary salt may be prepared by a Gabriel reaction starting from styrene, such as chloromethyl styrene. The polymeric matrix of the nano-sized composites may be constituted by polystyrene homopolymer and by a block copolymer of styrene and quaternary salt of the styrene units, such as amino methyl styrene units.

A suitable nano-sized composite may include a hexahydrophthalic anhydride cured diglycidyl ether of bisphenol A (DGEBA) resin, such as Epikote 8283 or the like.

The glass transition temperature of the nano-sized composites may increase as a percentage of organophilic clay may increase. Thus, the glass transition temperature of the nano-sized composites may be based on or may correspond to the percentage of organophilic clay in the nano-sized composites. The average molar masses of the polymeric matrix may be decreased because of a termination reaction and/or a chain-transfer reaction that may be caused by the organophilic clay during the polymerization process. As a result, a reinforcing action of the hybrid structure may be increased by the presence of the reactive organophilic clay in the hybrid structure.

Incorporation of nano-sized composites of polymer modified clays may improve toner properties associated with resistance to impaction of external surface additives, such as blocking behavior of the toner particles and document offset and vinyl offset characteristics of the toner particles. Moreover, incorporating the nano-sized composites into the toner particles may improve charging performance of the toner particles in the developer for forming digital printing images. Clay purity of the silicate clays may affect the properties of the nano-sized composite properties.

By including the nano-sized composites in the toner particle formation process, the polymer modified silicate clay particles may be made to be distributed in the polymer binder of the toner particle, including in either or both of a toner core and a shell layer in a core-shell structure of the toner particles. The nano-sized composites may or may not be distributed substantially uniformly throughout the toner binder of the toner core particle and/or the toner shell layer.

The nano-sized composites presence in the binder of the toner particles may be found to improve the toner particles RH sensitivity, elastic modulus, charging performance and blocking temperature. As a result, the low humidity RH zone charge of the toner is substantially improved, and the RH sensitivity ratio, that is, the ratio of the toner's charge in a high humidity RH zone to the toner's charge in a low humidity RH zone, may be substantially improved. The nano-sized composite present in the binder may be found to reduce water vapor permeability and additive impaction on the toner particles. Moreover, the nano-sized composite presence in the binder of the toner particles may be found to improve the triboelectrical charging performance of the toner particles.

The toner particles described herein may be comprised of polymer binder, at least one colorant, and suitable nano-sized composites that are distributed throughout the binder of the core and/or the shell for EA toner particles.

In a further embodiment, the toner particles have a core-shell structure. In this embodiment, the core is comprised of the toner particle materials, including at least the binder and a colorants Once the core particle is formed and aggregated to a desired size, a thin outer shell is then formed upon the core particle. The shell may comprise a binder material, although other components may be included therein if desired. The nano-sized clay composites may be distributed in the core binder, the shell layer binder, or both.

In embodiments, the polymer binder may include a polyester based polymer binder. Illustrative examples of suitable polyester-based polymer binders may include any of the various polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, polypropoxylated bisphenol-fumarate), poly(propoxylated bisphenol-succinate), poly propoxylated bisphenol-adipate), poly(propoxylated bisphenol-glutarate), SPAR™ (Dixie Chemicals), BECKOSOL™ (Reichhold Chemical Inc), ARAKOTE™ (Ciba-Geigy Corporation), HETRON™ (Ashland Chemical), PARAPLEX™ (Rohm & Hass), POLYLITE™ (Reichhold Chemical Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation) mixtures thereof and the like.

Examples of polyester based polymers may include alkali copoly(5-sulfoisophthaloyl)-co-poly(ethylene-adipate), alkali copoly(5-sulfoisophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), and alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly (ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly (pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly (5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)copoly(hexylene-adipate), poly(octylene-adipate).

Other examples of materials selected for the polymer binder may include polyolefins, such as polyethylene, polypropylene, polypentene, polydecene, polydodecene, polytetradecene, polyhexadecene, polyoctadene, and polycyclodecene, polyolefin copolymers, mixtures of polyolefins, bi-modal molecular weight polyolefins, functional polyolefins, acidic polyolefins, hydroxyl polyolefins, branched polyolefins, for example, such as those available from Sanyo Chemicals of Japan as VISCOL 550P™ and VISCOL 660P™.

In embodiments, the polymer binder may include specific polymer resins, for example, poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-propyl acrylate), poly(styrene-butyl acrylate), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar polymers.

In embodiments, the polymer binder may include a styrene-alkyl acrylate binder. The styrene-alkyl acrylate may be a styrene-butyl acrylate copolymer resin, such as a styrene-butyl acrylate-β-carboxyethyl acrylate polymer resin. The styrene-butyl acrylate-β-carboxyethyl acrylate polymer may be comprised of about 70 to about 85% styrene, about 12 to about 25% butyl acrylate, and about 1 to about 10% β-carboxyethyl acrylate.

In embodiments, suitable polymers that can be used for the binder material of the core portion of the EA toner particles may include crystalline resins and amorphous resins such as formed from polyester-based monomers, polyolefins, polyketones, polyamides, and the like. The shell portion of the EA toners may be include an amorphous resin and may be substantially free to completely free of crystalline resin.

Mixtures of two or more of the above polymers may also be used, if desired.

In embodiments, the polymer binder may be comprised of a mixture of two binder materials of differing molecular weights, such that the binder has a bimodal molecular weight distribution (that is, molecular weight peaks at least at two different molecular weight regions). For example, in one embodiment, the polymer binder is comprised of a first lower molecular weight binder and a second high molecular weight binder. The first binder can have a number average molecular weight (Mn), as measured by gel permeation chromatography (GPC), of from, for example, about 1,000 to about 30,000, and more specifically from about 5,000 to about 15,000, a weight average molecular weight (Mw) of from, for example, about 1,000 to about 75,000, and more specifically from about 25,000 to about 40,000, and a glass transition temperature of from, for example, about 40° C. to about 75° C. The second binder can have a substantially greater number average and weight average molecular weight, for example over 1,000,000 for Mw and Mn, and a glass transition temperature of from, for example, about 35° C. to about 75° C. The glass transition temperature may be controlled, for example by adjusting the amount acrylate in the binder. For example, a higher acrylate content can reduce the glass transition temperature of the binder. The second binder may be referred to as a gel, that is, a highly crosslinked polymer, due to the extensive gelation and high molecular weight of the latex. In this embodiment, the gel binder may be present in an amount of from about 0% to about 30% by weight of the total binder or from about 8% to about 35% by weight of the total binder.

The gel portion of the polymer binder distributed throughout the first binder can be used to control the gloss properties of the toner. The greater the amount of gel binder, the lower the gloss in general.

Both polymeric binders may be derived from the same monomer materials, but made to have different molecular weights, for example through inclusion of a greater amount of crosslinking in the higher molecular weight polymer. The first, lower molecular weight binder may be selected from among any of the aforementioned polymer binder materials. The second gel binder may be the same as or different from the first binder. For example, the second gel binder may be comprised of highly crosslinked materials such as poly(styrene-alkyl acrylate), poly(styrene-butadiene), poly(styrene-isoprene), poly(styrene-alkyl methacrylate), poly(styrene-alkyl acrylate-acrylic acid), poly(styrene-alkyl methacrylate-acrylic acid), poly(alkyl methacrylate-alkyl acrylate), poly (alkyl methacrylate-aryl acrylate), poly(aryl methacrylate-alkyl acrylate), poly(alkyl methacrylate-acrylic acid), poly (styrene-alkyl acrylate-acrylonitrileacrylic acid), and poly (alkyl acrylate-acrylonitrile-acrylic acid), and/or mixtures thereof. The gel binder may be the same as the first binder, and both are a styrene acrylate, and in embodiments, styrene-butyl acryl ate. The higher molecular weight of the second gel binder may be achieved by, for example, including greater amounts of styrene in the monomer system, including greater amounts of crosslinking agent in the monomer system and/or including lesser amounts of chain transfer agents.

The gel latex may comprise submicron crosslinked resin particles of about 10 to about 400 nanometers or about 20 to about 250 nanometers, suspended in an aqueous water phase containing a surfactant.

In a core-shell structured toner, the shell can be comprised of a latex resin that is the same as a latex of the core particle, although the shell can be free of gel latex resin. The shell latex may be added to the toner aggregates in an amount of about 5 to about 40 percent by weight of the total binder materials or in an amount of about 5 to about 30 percent by weight of the total binder materials. The shell or coating on the toner aggregates may have a thickness of about 0.2 to about 1.5 μm or about 0.5 to about 1.0 μm.

The total amount of binder, including core and shell if present, can be an amount of from about 60 to about 95% by weight of the toner particles (that is, the toner particles exclusive of external additives) on a solids basis or from about 70 to about 90% by weight of the toner.

Toner particles often also contain at least one colorant. As used herein, the colorant may include pigment, dye, mixtures of dyes, mixtures of pigments, mixtures of dyes and pigments, and the like. The colorant may be present in an amount of from about 2 weight percent to about 35 weight percent, such as from about 3 weight percent to about 25 weight percent or from about 3 weight percent to about 15 weight percent, of the toner particles as described herein. A colorant dispersion may be added into a starting emulsion of polymer binder for the EA process.

Suitable example colorants may include, for example, carbon black like REGAL 330® magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments may include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like.

Generally, colorants that can be selected are black, cyan, magenta, or yellow, and mixtures thereof. Examples of magentas are 2,9-dimethyl-substituted quinacridone and anthraquinon dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido)phthalocyanine, x-copper phthalocyanine pigment listed in the Color index as CI 74160, CI Pigment Blue, and Anthrathrene Blue, identified in the Color index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN. CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants may be selected, such as Levanyl Black. A-SF (Miles, Bayer) and Sunsperse Carbon Black LUD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (Dupont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

In addition to the latex polymer binder and the colorant, the toners may contain a wax dispersion. The wax may be added to the toner formulation in order to aid toner offset resistance, for example, toner release from the fuser roll, particularly in low oil or oil-less fuser designs. For emulsion aggregation (EA) toners, for example styrene-acrylate EA toners, linear polyethylene waxes such as the POLYWAX®; line of waxes available from Baker Petrolite may be useful. Of course, the wax dispersion may also comprise polypropylene waxes, other waxes known in the art, and mixtures of waxes.

The toners may contain from, for example, about 5 to about 15% by weight of the toner, on a solids basis, of the wax. In embodiments, the toners may contain from about 8 to about 12% by weight of the wax.

A modulus of the toner particles may be improved by incorporating the nano-sized composites into the toner particles. As a result, the modulus of the toner particles may be a primary mechanical property that may improved through the inclusion of nano-sized composites, such as the exfoliated clays. A degree of improvement may be achieved based on the high aspect ratio of the exfoliate clay layers or platelets included into toner particles. The reinforcement action may be provided through the exfoliation of the clay layers or platelets and may be due to shear deformation and stress transfer to the layers or platelets of clay.

The nano-sized composites with the polymer modified clays, such as the hexahydrophthalic anhydride cured DGEBA nano-composite, may exhibit a reduction in water vapor permeability. A nano-sized filler may be used with an organically modified hydrotalcite which, in contrast with to layered silicates, may have a positive layer charge in the gallery which may be counter balanced by anions. The water vapor permeability of the highly intercalated nano-sized composites may be, for example, about 5 to about 10 times reduced at a content of about 3 wt % and about 5 wt % hydrotalcites, respectively, when compared with a neat polymer.

The nano-sized composites having the polymer modified silicate clay may be added to the toner particle so as to be distributed in the polymer binder of the toner particles. The nano-sized composites may be distributed in the polymer binder of one or both of the toner core particle and shell layer in a core-shell toner particle structure.

To be added to an emulsion aggregation toner process, the nano-sized composites may be made into a dispersion, for example by dispersing the nano-sized composites particles in water, with or without the use of surfactants, to form an aqueous dispersion. The solids content of the dispersion may be from about 5 to about 35% of the dispersion.

The nano-sized composites may be included in the toner particles in a total amount (for example, including amounts in both a core and shell layer in core-shell structures) of from about 2 to about 15% by weight of the toner particles or in an amount of from about 3 to about 10% by weight of the toner particles.

The nano-sized composites within the shell binder of the toner particles may be present in an amount of about 0.1% to about 5% by weight of the toner particles. In embodiments, the nano-sized composites in the shell binder of the toner particles may form a monolayer on the core of the toner particles and may be in an amount of about 0.1% by weight to about 2% by weight of the toner particles.

The toners may also optionally contain a flow agent such as colloidal silica. The flow agent, if present) may be any colloidal silica such as SNOWTEX OL/OS colloidal silica. The colloidal silica may be present in the toner particles, exclusive of external additives and on a dr weight basis, in amounts of from 0 to about 15%, by weight of the toner particles or from about greater than 0 to about 10% by weight of the toner particles.

The toner particles may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions, cetyl pyridinium tetrafluoroborates, distearyl dimethyl ammonium methyl sulfate, aluminum salts or complexes, and the like.

Any suitable process may be used to form the toner particles without restriction. In embodiments, the emulsion aggregation procedure may be used in forming emulsion aggregation toner particles. Emulsion aggregation procedures typically include the basic process steps of at least aggregating the latex emulsion containing binder(s), the one or more colorants, the nano-sized composites, optionally one or more surfactants, optionally a wax emulsion, optionally a coagulant and one or more additional optional additives to form aggregates, optionally forming a shell on the aggregated core particles, subsequently optionally coalescing or fusing the aggregates, and then recovering, optionally washing and optionally drying the obtained emulsion aggregation toner particles.

An example emulsion/aggregation/coalescing process may include forming a mixture of latex binder, colorant dispersion, nano-sized composite dispersion, optional wax emulsion, optional coagulant and deionized water in a vessel. The mixture is stirred using a homogenizer until homogenized and then transferred to a reactor where the homogenized mixture is heated to a temperature of, for example, at least about 45° C. and held at such temperature for a period of time to permit aggregation of toner particles to a desired size. Additional latex binder may then be added to form a shell upon the aggregated core particles. Once the desired size of aggregated toner particles is achieved, the pH of the mixture is adjusted in order to inhibit further toner aggregation. The toner particles are further heated to a temperature of, for example, at least about 90° C., and the pH lowered in order to enable the particles to coalesce and spherodize. The heater is then turned off and the reactor mixture allowed to cool to room temperature, at which point the aggregated and coalesced toner particles are recovered and optionally washed and dried.

In preparing the toner by the emulsion aggregation procedure, one or more surfactants may be used in the process. Suitable surfactants include anionic, cationic and nonionic surfactants.

Anionic surfactants may include sodium dodecylsulfate (SDS), sodium dodecyl benzene sulfonate, sodium dodecylnaphthalene sulfate, dialkyl benzenealkyl, sulfates and sulfonates, abitic acid, the DOWFAX brand of anionic surfactants, and the NEOGEN brand of anionic surfactants. An example of an anionic surfactant may be NEOGEN RK available from Daiichi Kogyo Seiyaku Co. Ltd., which consists primarily of branched sodium dodecyl benzene sulphonate.

Examples of cationic surfactants include dialkyl benzene alkyl ammonium chloride, lauryl trimethyl ammonium chloride, alkylbenzyl methy ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a cationic surfactant may be SANISOL B-50 available from Kao Corp., which may consist primarily of benzyl dimethyl alkonium chloride.

Examples of nonionic surfactants may include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulene Inc. as IGEPAL CA-210, IGEPAL, CA-520, IGEPAL CA-720, IGEPAL, CO-890, IGEPAL, CO-720, IGEPAL CO-290, IGEPAL CA-210, ANTAROX 890 and ANTAROX 897. An example of a nonionic surfactant may be ANTAROX 897 available from Rhone-Poulenc Inc. which consists primarily of alkyl phenol ethoxylate.

Following coalescence and aggregation, the particles are wet sieved through an orifice of a desired size in order to remove particles of too large a size, washed and treated to a desired pH, and then dried to a moisture content of, for example, less than 1% by weight.

In embodiments, the toner particles can have an average particle size of from about 1 to about 15 μm or from about 5 to about 9 μm. The particle size may be determined using any suitable device, for example a conventional Coulter counter. The circularity may be determined using the known Malvern Sysmex Flow Particle image Analyzer FPIA-2100.

The toner particles may have a size such that the upper geometric standard deviation (GSD) by volume, GSDv, for (D84/D50) is in the range of from about 1.15 to about 1.25, such as from about 1.18 to about 1.23. The particle diameters at which a cumulative percentage of 50% of the total toner particles are attained are defined as volume D50, which are from about 5.45 to about 5.88, such as from about 5.47 to about 5.85. The particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). The upper GSDv value for the toner particles indicates that the toner particles are made to have a very narrow particle size distribution.

The toner particles can be blended with external additives following formation. Any suitable surface additives may be used. Examples of external additives may include one or more of $SiO_2$, metal oxides such as, for example, $TiO_2$ and aluminum oxide, and a lubricating agent such as, for example, a metal salt of a fatty acid (for example, zinc stearate (ZnSt), calcium stearate) or long chain alcohols such as UNILIN 700. In general, silica is applied to the toner surface for toner flow, triboelectrical enhancement, admix control, improved development and transfer stability and higher toner blocking temperature. $TiO_2$ is applied for improved relative humidity (RH) stability, triboelectrical control and improved development and transfer stability. Zinc stearate can also be used as an external additive for the toners, the zinc stearate providing lubricating properties. Zinc stearate provides developer conductivity and triboelectrical enhancements both due to its lubricating nature. In addition, zinc stearate enables higher toner charge and charge stability by increasing the number of contacts between toner and carrier particles. Calcium stearate and magnesium stearate provide similar functions. In embodiments, commercially available zinc stearate known as Zinc Stearate L, obtained from Ferro Corporation is used. The external surface additives may be used with or without a coating.

The toners can contain from, for example, about 0.5 to about 5 weight percent titania (size of from about 10 nm to about 50 nm or about 40 nm), about 0.5 to about 5 weight percent silica (size of from about 10 nm to about 50 nm or about 40 nm), about 0.5 to about 5 weight percent spacer particles.

The toner particles may optionally be formulated into a developer composition by mixing the toner particles with carrier particles. Illustrative examples of carrier particles may be selected for mixing with the toner composition include those particles that are capable of triboelectrically obtaining a charge of opposite polarity to that of the toner particles. Accordingly, in one embodiment, the carrier particles may be selected so as to be of a positive polarity in order that the toner particles that are negatively charged will adhere to and surround the carrier particles. Illustrative examples of such carrier particles may include granular zircon, granular silicon, glass, steel, nickel, iron ferrites, silicon dioxide, and the like. Additionally, there can be selected as carrier particles nickel berry carriers which may be comprised of nodular carrier beads of nickel characterized by surfaces of reoccurring recesses and protrusions thereby providing particles with a relatively large external area.

The selected carrier particles may be used with or without a coating, the coating may be comprised of fluoropolymers, such as polyvinylidene fluoride resins) terpolymers of styrene, methyl methacrylate, and a silane, such as triethoxy silane, tetrafluoroethylenes, other known coatings and the like.

An example of a carrier herein is a magnetite core, from about 35 μm to 75 μm in size, coated with about 0.5% to about 5% by weight or about 1.5% by weight of a conductive polymer mixture comprised on methyl acrylate and carbon black. Alternatively, the carrier cores may be iron ferrite cores of about 35 microns to about 75 micron in size, or steel cores, for example of about 50 to about 75 μm in size.

The carrier particles may be mixed with the toner particles in various suitable combinations. The concentrations are usually about 1% to about 20% by weight of toner and about 80% to about 99% by weight of carrier. However, different toner and carrier percentages may be used to achieve a developer composition with desired characteristics.

The toners can be used in known electrostatographic imaging methods. Thus for example, the toners or developers may be charged, for example, triboelectrically, and applied to an oppositely charged latent image on an imaging member such as a photodetector or ionographic receiver. The resultant toner image may then be transferred, either directly or via an intermediate transport member, to an image receiving substrate such as paper or a transparency sheet. The toner image may then be fused to the image receiving substrate by application of heat and/or pressure, for example with a heated fuser roll.

Example I

A resin emulsion (Latex A) comprised of 3.5 percent by weight of montmorillonite clay and calcium salt.

A 2 liter buchi reactor equipped with a mechanical stirrer and hot oil jacket is charged with 500 g deionized ("DI") water, 4 grams DOWFAX 2A1 (anionic emulsifier solutions, and 20.4 g sodium salt of montmorillonite clay (N available from Nanocor) to form a mixture. The mixture is stirred at 300 rpm and heated to 80° C., followed by the addition of 1.6 grams of calcium hydroxide in 10 grams of water. Then, 8 grams of β-CEA (β-carboxy ethyl acrylate) is added to the mixture, followed by the addition of 3 g of a sodium and 8.1 grams of ammonium persulfate initiator dissolved in 45 grams of de-ionized water.

In a separate vessel, a monomer emulsion is prepared in the following manner. First, 426.6 grams of styrene, 113.4 grams of n-butyl acrylate and 8 grams of β-CEA, 11.3 grams of 1-dodecanethiol, 1.89 grams of ADOD, 10.59 grams of DOWFAX (anionic surfactant), and 257 grams of deionized water are mixed to form the monomer emulsion. The ratio of styrene monomer to n-butyl acrylate monomer by weight is 79 to 21 percent. The above emulsion is then slowly fed into the reactor containing at 76° C. to form the "seeds" while being purged with nitrogen. The initiator solution is then slowly charged into the reactor and after 20 minutes, the rest of the emulsion is continuously fed in using metering pumps. Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag.

Preparation of Latex Emulsion A.

A latex emulsion comprised of polymer particles generated from the semi-continuous emulsion polymerization of styrene, n-butyl acrylate and beta carboxy ethyl acrylate (β-CEA) is prepared as follows. This reaction formulation is prepared in a 2 liter Buchi reactor, which can be readily scaled-up to a 100 gallon scale or larger by adjusting the quantities of materials accordingly.

Example II

An emulsion resin (Latex B) is derived from styrene, n-butyl acrylate and beta carboxy ethyl acrylate.

A surfactant solution consisting of 0.9 grams DOWFAX 2A1 (anionic emulsifier) and 514 grams de-ionized water is prepared by mixing for 10 minutes in a stainless steel holding tank. The holding tank is then purged with nitrogen for 5 minutes before transferring into the reactor. The reactor is then continuously purged with nitrogen while being stirred at 300 RPM. The reactor is then heated up to 76° C. at a controlled rate and held constant.

In a first separate container, 8.1 grams of ammonium persulfate initiator is dissolved in 45 grams of de-ionized water. In a second separate container, the monomer emulsion is prepared in the following manner. First, 426.6 grams of styrene, 113.4 grams of n-butyl acrylate and 16.2 grams of β-CEA, 11.3 grams of 1-dodecanethiol, 10.59 grams of DOWFAX (anionic surfactant), and 257 grams of deionized water are mixed to form the monomer emulsion. The ratio of styrene monomer to n-butyl acrylate monomer by weight is 79 to 21 percent. One percent of the monomer emulsion is then slowly fed into the reactor containing the aqueous surfactant phase at 76° C. to form the "seeds" while being purged with nitrogen. The initiator solution is then slowly charged into the reactor and after 20 minutes the rest of the emulsion is continuously fed in using metering pumps. Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag.

Example III

Preparation of toner particles wherein the core and shell is comprised of the resinated clay latex of Example I.

Into a 4 liter glass reactor equipped with an overhead stirrer and heating mantle is dispersed 639.9 grams of the above Latex Emulsion A (Example I), 92.6 grams of a Blue Pigment PB15:3 dispersion having a solids content of 26.49 percent into 1462.9 grams of water with high shear stirring by means of a polytron. To this mixture is added 54 grams of a coagulant solution consisting of 10 weight percent poly(aluminium-chloride)(PAC) and 90 wt. % 0.02M $HNO_3$ solution. The PAC solution is added drop-wise at low rpm and as the viscosity of the pigmented latex mixture increases, the rpm of the polytron probe also increases to 5,000 rpm for a period of 2 minutes. This produces a flocculation or heterocoagulation of gelled particles consisting of nanometer sized latex particles, 9% wax and 5% pigment for the core of the particles.

The pigmented latex/wax slurry is heated at a controlled rate of 0.5° C./minute up to approximately 52° C. and held at this temperature or slightly higher to grow the particles to approximately 5.0 microns. Once the average particle size of 5.0 microns is achieved, 308.9 grams of the Latex Emulsion A (of Example I) is then introduced into the reactor while stirring. After an additional 30 minutes to hour the particle size measured is 5.7 microns having a size distribution with a geometric standard deviation (GSD), by volume or by number, of 1.20. The pH of the resulting mixture is then adjusted from 2.0 to 7.0 with aqueous base solution of 4 percent sodium hydroxide and allowed to stir for an additional 15 minutes. Subsequently, the resulting mixture is heated to 93° C. at 1.0° C. per minute and the particle size measured is 5.98 microns with a GSD by volume of 1.22 and GSD by number of 1.22. The pH is then reduced to 5.5 using a 2.5 percent Nitric acid solution. The resultant mixture is then allowed to coalesce for 2 hrs at a temperature of 93° C.

The morphology of the particles is smooth and "potato" shape. The final particle size after cooling but before washing is 5.98 microns with a GSD by volume of 1.21. The particles are washed 6 times, where the 1st wash is conducted at pH of 10 at 63° C., followed by 3 washes with deionized water at room temperature, one wash carried out at a pH of 4.0 at 40° C., and finally the last wash with deionized water at room temperature. The final average particle size of the dried particles is 5.77 microns with $GSD_v$=1.21 and $GSD_n$=1.25. The glass transition temperature of this sample is measured by DSC and found to have Tg(onset)=49.4° C.

Example IV

Preparation of toner particles wherein the core is comprised of Latex B (Example II), and the shell is comprised of the resinated clay latex A of Example I.

Into a 4 liter glass reactor equipped with an overhead stirrer and heating mantle is dispersed 639.9 grams of the above Latex Emulsion B (Example II) 92.6 grams of a Blue Pigment PB15:3 dispersion having a solids content of 26.49 percent into 1462.9 grams of water with high shear stirring by means of a polytron. To this mixture is added 54 grams of a coagulant solution consisting of 10 weight percent PAC and 90 wt. % 0.02M $HNO_3$ solution. The PAC solution is added dropwise at low rpm and as the viscosity of the pigmented latex mixture increases the rpm of the polytron probe also increases to 5,000 rpm for a period of 2 minutes. This produces a flocculation or heterocoagulation of gelled particles consisting of nanometer sized latex particles, 9% wax and 5% pigment for the core of the particles.

The pigmented latex/wax slurry is heated at a controlled rate of 0.5° C./minute up to approximately 52° C., and held at this temperature or slightly higher to grow the particles to approximately 5.0 microns. Once the average particle size of 5.1 microns is achieved, 308.9 grams of the Latex Emulsion A (of Example I) is then introduced into the reactor while stirring. After an additional 30 minutes to 1 hour the particle size measured is 5.9 microns with a GSD of 1.21. The pH of the resulting mixture is then adjusted from 2.0 to 7.0 with aqueous base solution of 4 percent sodium hydroxide and allowed to stir for an additional 15 minutes. Subsequently, the resulting mixture is heated to 93° C. at 1.0° C. per minute and the particle size measured is 5.99 microns with a GSD by volume of 1.23 and GSD by number of 1.23. The pH is then reduced to 5.5 using a 2.5 percent nitric acid solution. The resultant mixture is then allowed to coalesce for 2 hrs at a temperature of 93° C.

The morphology of the particles is smooth and "potato" shape. The final particle size after cooling but before washing is 6 microns with a GSD by volume of 1.22. The particles are washed 6 times, where the first wash is conducted at pH of 10 at 63° C., followed by 3 washes with deionized water at room temperature, one wash carried out at a pH of 4.0 at 40° C., and finally the last wash with deionized water at room temperature. The final average particle size of the dried particles is 5.8 microns with $GSD_v$=1.21 and $GSD_n$=1.24. The glass transition temperature of this sample is measured by differential scanning calorimeter) and found to have Tg(onset)=49.6° C.

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. Toner particles comprising:

a polymer binder;

at least one colorant; and nano-sized clay composites distributed in the binder, wherein the nano-sized clay composites comprise a polymer modified clay component comprised of a polymer resin penetrated into interlayer spacings of clay particles, wherein the polymer resin is selected from the group consisting of a polyester resin, a styrenic resin, an epoxy resin and an acrylate resin, and wherein the nano-sized clay composites have a structure selected from the group consisting of an exfoliated structure, an intercalated structure, a tactoid structure, and mixtures thereof.

2. The toner according to claim 1, wherein the polymer binder is selected from the group consisting of acrylate-containing resin, sulfonated polyester resin, non-sulfonated polyester resin, acid containing polyester resin, and mixtures thereof.

3. The toner according to claim 1, wherein the toner particles further comprise a shell layer thereon, wherein the shell layer comprises a polymer binder and the nano-sized clay composites.

4. The toner according to claim 3, wherein the clay particles of the nano-sized clay composites have an average particle size of from about 10 nm to about 200 nm.

5. The toner according to claim 1, wherein the clay particles of the nano-sized clay composites comprise from about 1% to about 20% by weight of the polymer modified clay component.

6. The toner according to claim 1, wherein the nano-sized clay composites comprise from about 0.1% to about 5% by weight of a total amount of the polymer binder.

7. The toner according to claim 1, wherein the polymer modified clay component comprises silicate clay particles.

8. The toner according to claim 7, wherein the silicate clay particles are selected from the group consisting of aluminosilicate clay, magnesiosilicate clay, hydrotalcite clay, and mixtures thereof.

9. A developer comprising the toner particles according to claim 1 and carrier particles.

10. The toner according to claim 1, wherein the polymer binder is crystalline resin or a mixture of crystalline resin and amorphous resin.

11. A toner comprising toner particles having a core with a shell layer thereon, the core comprising a binder and at least one colorant, and the shell comprising a binder, and wherein the core, the shell, or both further include nano-sized clay composites comprised of a polymer modified clay component comprised of a polymer resin penetrated into interlayer spacings of clay particles, wherein the polymer resin is selected from the group consisting of a polyester resin, a styrenic resin, an epoxy resin and an acrylate resin, and wherein the nano-sized clay composites have a structure selected from the group consisting of an exfoliated structure, an intercalated structure, a tactoid structure, and mixtures thereof.

12. The toner according to claim 11, wherein the binder of the core and/or of the shell is selected from the group consisting of acrylate-containing resin, sulfonated polyester resin, non-sulfonated polyester resin, acid containing polyester resin, and mixtures thereof.

13. The toner according to claim 11, wherein the nano-sized clay composites comprise from about 0.1% to about 5% by weight of a total amount of the binder.

14. The toner according to claim 11, wherein the nano-sized clay composites include silicate clay selected from the group consisting of aluminosilicate clay, magnesiosilicate clay, hydrotalcite clay, and mixtures thereof.

15. The toner according to claim 11, wherein the clay particles of the nano-sized clay composites have an average particle size of from about 10 nm to about 200 nm.

16. The toner according to claim 11, wherein the binder of the core and/or of the shell is selected from the group consisting of crystalline resin or a mixture of crystalline resin and amorphous resin.

17. Toner particles comprising:

a polymer binder;

at least one colorant; and nano-sized clay composites distributed in the binder, wherein the nano-sized clay composites comprise a polymer modified clay component comprised of a polymer resin penetrated into interlayer spacings of silicate clay particles, wherein the polymer resin is selected from the group consisting of a polyester resin, a styrenic resin, an epoxy resin and an acrylate resin, and wherein the nano-sized clay composites have a structure selected from the group consisting of an exfoliated structure, an intercalated structure, a tactoid structure, and mixtures thereof.

18. The toner particles according to claim 17, wherein the polymer binder is crystalline resin or a mixture of crystalline resin and amorphous resin.

19. The toner particles according to claim 17, wherein the polymer binder is selected from the group consisting of acrylate-containing resin, sulfonated polyester resin, non-sulfonated polyester resin, acid containing polyester resin, and mixtures thereof.

20. The toner particles according to claim 17, wherein the toner particles have a core-shell structure, wherein both the core and the shell include polymer binder, and wherein the nano-sized clay composites are distributed in the polymer binder of the core, the polymer binder of the shell, or both.

21. The toner particles according to claim 17, wherein the nano-sized clay composites comprise from about 0.1% to about 5% by weight of a total amount of the binder.

22. The toner particles according to claim 17, wherein the silicate clay particles have an average particle size of from about 1 nm to about 500 nm.

23. A developer comprising the toner particles according to claim 17 and carrier particles.

* * * * *